United States Patent [19]

Kuehn

[11] 4,456,131

[45] Jun. 26, 1984

[54] REMOTE CONTROLLED LINE LOCKING, SLACK PULLING CABLE LOGGING CARRIAGE

[75] Inventor: Scott L. Kuehn, Missoula, Mont.

[73] Assignee: Champion International Corporation, Stamford, Conn.

[21] Appl. No.: 492,743

[22] Filed: May 9, 1983

Related U.S. Application Data

[63] Continuation-in-part of Ser. No. 388,886, Jun. 16, 1982.

[51] Int. Cl.[3] ..... B66C 21/00; B61H 7/12; E01B 29/22

[52] U.S. Cl. ..... 212/97; 212/87; 212/89; 212/92; 212/122; 188/64; 188/43; 254/379

[58] Field of Search ..... 212/76–123; 254/303, 314–315, 349, 360, 367, 379, 386; 188/43–44, 64, 106 P, 65.1, 65.3

[56] References Cited

U.S. PATENT DOCUMENTS

| | | | |
|---|---|---|---|
| 68,874 | 9/1867 | Hawley | 212/114 |
| 1,121,742 | 12/1914 | McCoy | 212/114 |
| 3,079,008 | 2/1963 | Naud | 212/96 |
| 3,083,839 | 4/1963 | McIntyre | 212/98 |
| 3,776,390 | 12/1973 | Junes et al. | 212/89 |
| 4,109,810 | 8/1978 | Jones | 254/315 |
| 4,164,289 | 8/1979 | Halicwicz | 212/76 |

FOREIGN PATENT DOCUMENTS

| | | | |
|---|---|---|---|
| 682660 | 3/1964 | Canada | 212/89 |
| 1161401 | 1/1964 | Fed. Rep. of Germany | 254/315 |

*Primary Examiner*—Trygve M. Blix
*Assistant Examiner*—R. B. Johnson
*Attorney, Agent, or Firm*—Evelyn M. Sommer; William W. Jones

[57] ABSTRACT

A remote controlled slack pulling log skidding carriage is provided for feeding a slack drag line toward a log to be skidded. A drive sheave rotatably mounted in the carriage is operated by a hydraulic motor. The fluid to operate the motor is stored in one or more accumulators, and a radio controlled valve starts and stops the flow of fluid to the motor. A mechanically operated hydraulic pump also is provided to recharge the accumulators during a skidding operation. A reciprocating locking assembly is provided to alternately lock the carriage to the skyline or to the slack line.

2 Claims, 9 Drawing Figures

REMOTE CONTROLLED LINE LOCKING, SLACK PULLING CABLE LOGGING CARRIAGE

BACKGROUND OF THE INVENTION

This is a continuation-in-part of co-pending application Ser. No. 388,886, filed June 16, 1982.

In conventional logging operations, the initial transportation of a felled tree from the location where it is cut to a location where it can be efficiently transported to a mill is a major logistical problem. Heretofore, temporary roads were constructed throughout the forest area being harvested thereby making the felled trees readily accessible to tractors. Generally, tractors are employed to move each felled tree to a location where it could be transferred to a more convenient mode of transportation. In recent years, however, issues of soil compaction, soil erosion and road building costs have significantly affected the ability to access logs by tractor. This has been particularly true in connection with logging operations carried on federally owned areas. Today, there typically is a greater distance between roads, and logs often are hooked to cables and are dragged or skidded by a skidding machine located on one of the roads. This method is cable logging—defined as any log or tree yarding system employing winches in a fixed position. Whereas in the past, this technique for skidding logs was used only on very steep terrain that was inaccessible to tractors, it is now being used increasingly on gentle slopes between widely spaced roads.

Logging terminology is not highly standardized. The terminology used here should be recognizable by university trained logging engineers. Carriages are defined here as load-carrying devices from which logs are suspended and which ride up and down a suspended cable (either fixed or movable)— "a skyline." A skidding line extends from log attachment cables (chokers) or tongs through the carriage to a cable logging machine containing winches and a power source. Such machines are converted commercial construction cranes or are otherwise similar in principle. The cable logging machine is located at a higher elevation than the logs to be skidded, and it can selectively pull in or let out either or both of the lines. The end of the skyline away from the skidding machine is attachd to an immovable object or anchor such as a tree or stump. The end of the skidding line away from the cable logging machine is attached to the log that is to be skidded.

The typical carriage made according to prior art teachings includes a skyline sheave which rotates along the skyline. Both the skyline and the skidding line have a braking system integral to the winches of the cable logging machine. The movement of the carriage is controlled by paying out skidding line or retracting the skidding line by a winch. Prior art carriages can be limited in travel along the skyline by mechanically or electronically controlled clamps affixed to the skyline or the carriage to facilitate skidding.

A log skidding operation commences with the carriage close to the skidding machine. The skyline is unwound by the skidding machine and is pulled by workers to the immovable object that functions as an anchor. The object may be a tree or tree stump. The skyline is then pulled tight between the skidding machine and the anchor. The skidding line then is let out allowing the sheave to roll downhill along the skyline, carrying the carriage and skidding line toward the anchor point. The carriage stops moving downhill when the carriage stop device is encountered or actuated as previously described, after which the cable logging machine then unwinds the skidding line further and the free end of the skidding line is attached by various means to the logs to be skidded. The skidding line is then pulled in by the cable logging machine. The carriage will be pulled along with the logs to the cable logging machine only after the carriage is released by either an automatic, mechanical unlocking device or from an electronically relayed signal from a worker.

This operation can be repeated many times without relocating the skidding machine and without moving the skyline to a new anchor point. All logs within a certain average lateral distance of the skyline, commonly some 50 to 75 feet or more, will be skidded without moving either end of the skyline. In prior art devices, such as that disclosed in U.S. Pat. No. 3,948,398, the free end of the drag line is moved to the log to be skidded by having one or more workers pull the free end of the drag line, while the skidding machine is letting out slack.

Although the log skidding capability of prior art log skidding carriages is generally acceptable, it has been found that frequently it is difficult for the workers to pull the heavy skidding line the required distance from the carriage to the log to be skidded. The difficulty of the slack pulling task often is exacerbated by extremely rugged steep terrain and often wet and slippery ground conditions. Specifically, the typical worker comfortably can exert a pull on the skidding line of approximately sixty pounds. However, in many operating conditions, a force substantially in excess of sixty pounds is required. For example, in a skidding operation using a 0.46 pound per foot line on a dry ten percent slope, the worker would have to exert a 120 pound force on the line when he is 600 feet from the skidding machine. This required force would be higher for a heavier weight line or at a greater distance from the skidding machine, or under different slope or ground moisture conditions.

Workers required to pull excessive forces are susceptible to injuries varying from pulled muscles to more serious injuries resulting from falls. The probability of injury generally increases in proportion to the force the worker is required to exert. As a result, employers either allocate additional personnel for slack pulling tasks, or periodically reallocate personnel from other ongoing responsiblities to assist in slack pulling. The result of either option is increased cost and decreased efficiency.

A few carriage mounted slack pulling devices are available. However, they are very large devices, weighing 1700 to 2500 pounds which are too large to be handled by cable logging machines equivalent in size to, or adapted from cranes of approximately the 50 ton class or less. Furthermore, they do not meet the mobility and other needs and specifications of cable logging with the above-mentioned class of cable logging machines.

SUMMARY OF THE INVENTION

The subject invention relates to a cable logging carriage of the gravity-fed live skyline type for use with equipment roughly equivalent in size and capability to a 50 ton crane. The carriage has radio-controlled hydraulically actuated devices to lock and unlock the carriage from the skyline and skidding line respectively and to pull skidding line slack to facilitate attaching logs to said line. In the preferred embodiment of the subject invention, as explained in detail below, the subject carriage locking device is operated by an hydraulic cylinder with the fluid to operate the cylinder being stored in one or more hydraulic accumulators. A valve is provided between the accumulators and the cylinder and may be opened to initiate the flow of fluid to the cylinder that actuates the carriage lock device. The lock device is a reciprocating clamp acting against the skyline or the skidding line and their respective sheaves. Preferably, the valve is electronically operated to open or close upon receipt of a radio signal from a worker who may be several hundred feet away. Fluid moving out of the cylinder is directed to a reservoir forming a portion of the subject apparatus. The cylinder is double acting and simultaneously locks the skidding line within the carriage when the carriage is unlocked from the skyline. The subject drive sheave for the slack pulling device is operated by a hydraulic motor, with the fluid to operate the hydraulic motor also being stored in one or more accumulators. A second valve is provided between the accumulators and the drive sheave and may be opened to initiate the flow of fluid to the hydraulic motor that actuates the drive sheave. Preferably, the second valve is also electronically operated to open or close upon receipt of a radio signal from a worker who may be several hundred feet away. Fluid moving from the accumulators through the motor is also directed to a reservoir forming a portion of the subject apparatus.

After a sufficient amount of slack is released from the log skidding machine and pulled through the carriage by the drive sheave, the line is affixed to the felled log(s), and the log(s) are skidded toward the cable logging machine in the typical manner. During the skidding operation, rotation of the skyline sheave along the skyline operates a pump which recycles the hydraulic fluid to the accumulators, thereby recharging the accumulators for a subsequent slack pulling operation.

The subject apparatus includes a sequence valve which measures the hydraulic pressure in the accumulators and which stops flow to the accumulators after they have been fully recharged. Once complete recharge is achieved as measured by the sequence valve, the pump operated by the skyline sheave merely recirculates the hydraulic fluid back into the reservoir.

To insure that the line remains in close contact with the drive sheave for feeding out the slack line, the subject apparatus includes a clutch sheave which is attached to the ram of a slave cylinder to force the skidding line against the drive sheave. The slave cylinder is activated upon flow of liquid from the accumulators through the radio controlled valve at the same time that the hydraulic motor is activated.

Accordingly, it is an object of the present invention to improve the efficiency of cable log skidding operations by providing a new and improved apparatus capable of being electronically operated by a worker.

It is another object of the subject invention to minimize the effort required by a worker for slack pulling aspects of cable log skidding operations.

It is a further object of the subject invention to provide an apparatus for locking the carriage to the skyline at various points and eliminate the labor and lost efficiency of purely mechanical carriage lock devices.

It is a further object of the subject invention to provide improved safety for workers in the slack pulling aspects of log skidding operations.

It is still another object of the subject invention to provide an apparatus for slack pulling operations that is lightweight, mobile and well adapted to a widely used class of cable logging operations.

These and other objects of the invention will become more readily apparent from the following detailed description of a preferred embodiment of the invention taken in conjunction with the accompanying drawings.

DETAILED DESCRIPTION OF THE PREFERRED EMBODIMENT

Figure 1:
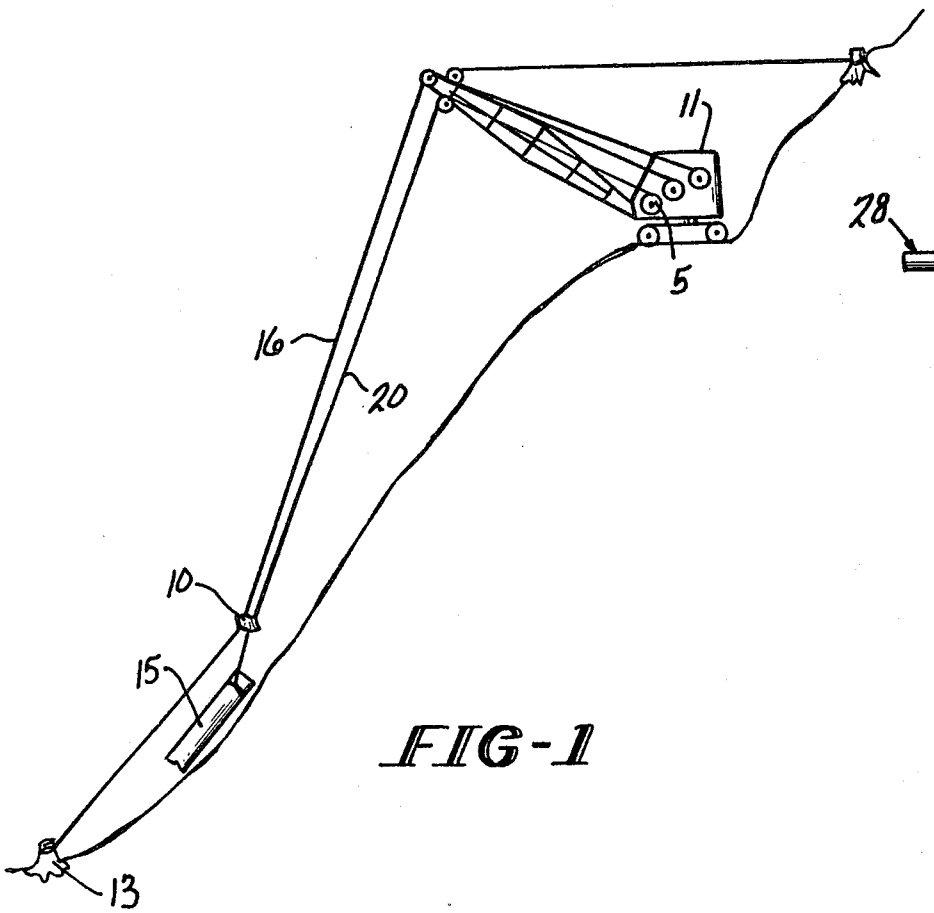
FIG. 1 is a schematic view of the log skidding apparatus of the subject invention in operation.

The slack pulling log skidding carriage 10 of the subject invention is adapted to be suspended from a skyline 16, as shown schematically in FIG. 1. Skyline 16 is pulled tightly between cable logging machine 11 and anchor 13 which is typically a tree or tree stump, however, it could be any other immovable object. Skidding line 20 extends through carriage 10 from cable logging machine 11 to log 15. Cable logging machine 11 is operative to pull in or let out skyline 16 and skidding line 20 either separately or simultaneously. The subject carriage 10 cooperates with cable logging machine 11 as described below to greatly facilitate the slack pulling aspects of log skidding operations.

Figure 2:
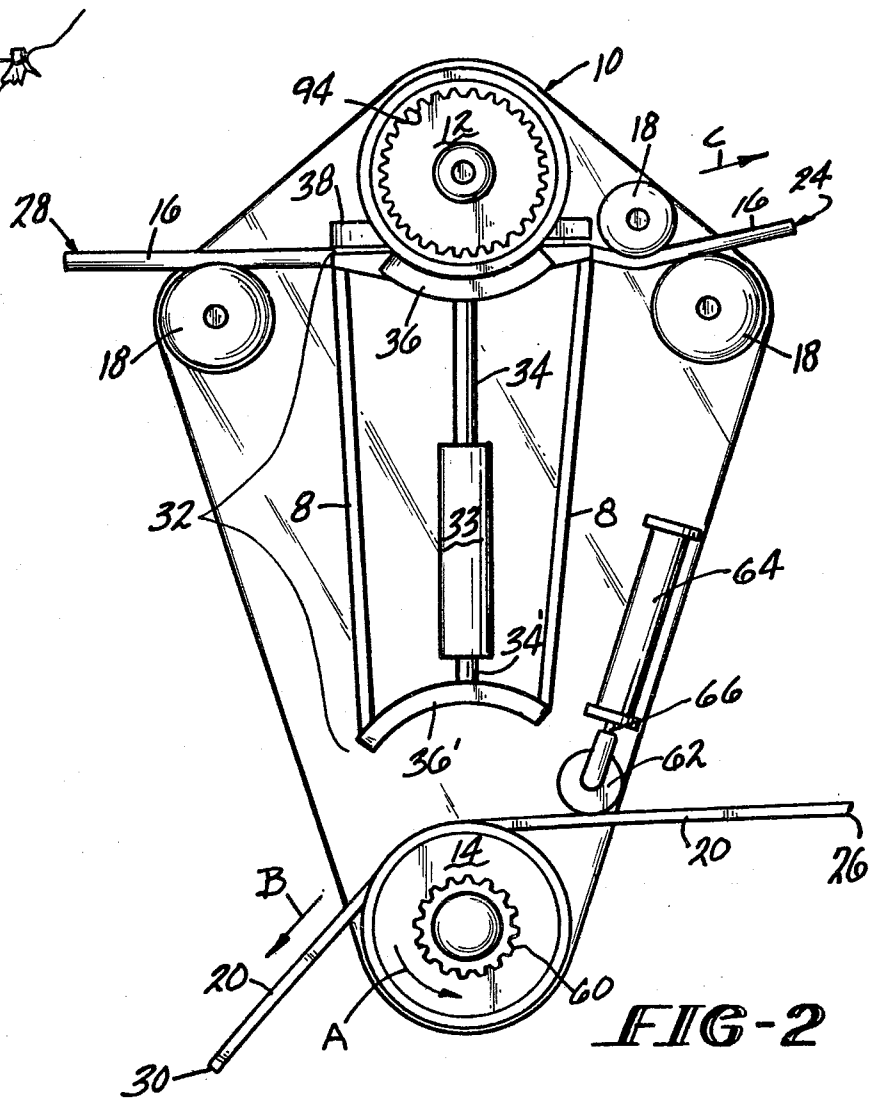
FIG. 2 is a schematic view of the sheaves, slack-pulling apparatus, and carriage lock arrangement mounted between two internal frame plates.

Referring to FIG. 2, the subject slack pulling log carriage 10 includes a skyline sheave 12 and a skidding line sheave 14, both of which are preferably made of metal and have a diameter of twelve inches. Skyline sheave 12 and skidding line sheave 14 are both mounted in carriage 10 to rotate about their central axes. Skyline 16 extends through carriage 10 and is guided into contact with skyline sheave 12 by three upper guide wheels 18. As illustrated in FIG. 2, the end 24 of skyline 16 and the end 26 of skidding line 20 both extend to the log skidding machine 11 (not shown). The opposite end 28 of skyline 16 extends to and is securely attached to the anchor point 13, while the opposite end 30 of skidding line 20 extends to and is securely attached to the log 15 to be skidded.

Carriage 10 further includes a line lock assembly 32, which consists of a double-acting brake cylinder 33 with two brake cylinder rams 34 and 34' with attached brake shoes 36 and 36'. Braces 8 extend between respective ends of the brake shoes 36 and 36'. The brake shoes 36 and 36' press alternately against skyline 16 and brake pad 38 or against skidding line 20 and skidding line sheave 14 respectively. A slave cylinder wheel 62 is located above skidding line 20 and is attached to slave cylinder 64 by slave cylinder ram 66.

Preferably, slave cylinder wheel 62 is of a metallic material, 4 to 6" in diameter. As shown in FIG. 2, slave cylinder ram 66 is retracted into slave cylinder 64 such that skidding line 20 is not in contact with slave cylinder wheel 62. Movement of slave cylinder ram 66 within slave cylinder 64 is accomplished by hydraulic pressure, as explained in greater detail below.

The skyline sheave 12 is provided with an internal drive gear 94 and the skidding line sheave 14 is provided with an external drive gear 60. The purpose of the gears 94 and 60 will be set forth in greater detail hereinafter.

Figure 3:
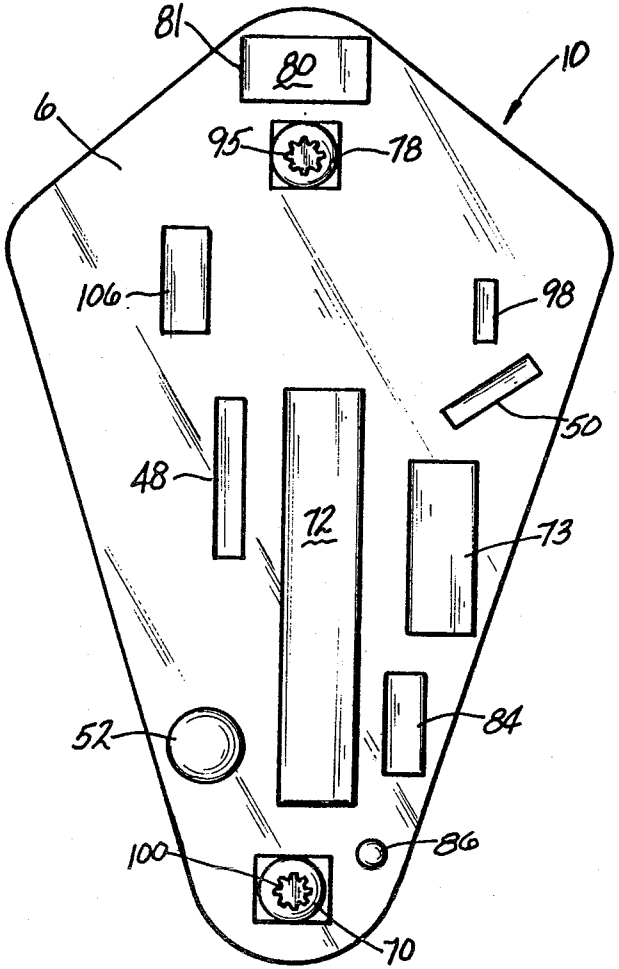
FIG. 3 is a schematic view of the mounting of parts on the left internal frame plate.

Referring now to FIG. 3, the carriage 10 includes an hydraulic motor 70 which is operably connected to skidding line sheave 14 by means of a gear 100 which engages the gear 60 on the skidding line sheave 14 so as to cause rotation of the skidding line sheave 14 in the direction shown by the arrow A (see FIG. 2). The cooperation of slave cylinder wheel 62, forcing skidding line 20 into contact with skidding line sheave 14, and the simultaneous rotation of skidding line sheave 14 in the direction indicated by arrow A feed the slack skidding line through carriage 10 in the direction indicated by arrow B shown in FIG. 2. An hydraulic fluid pump 78 is mounted in the frame of the carriage and includes a gear 95 which meshes with the internal drive gear 94 on the skyline sheave 12. Also mounted on the left side internal frame plate 6 are hydraulic fluid accumulators 72 and 73, relief valve 106, brake valve 48, slack puller valves 50 and 84, flow control valve 86, sequence valve 98, and oil filter 52. The radio receiver 80 which operates the various valves on receipt of a radio signal from a remote transmitter is mounted at the top of the frame plate 6 in a shock-protective box 81. The mode of operation of the various valves and accumulators will be described in greater detail hereinafter.

Figure 4:
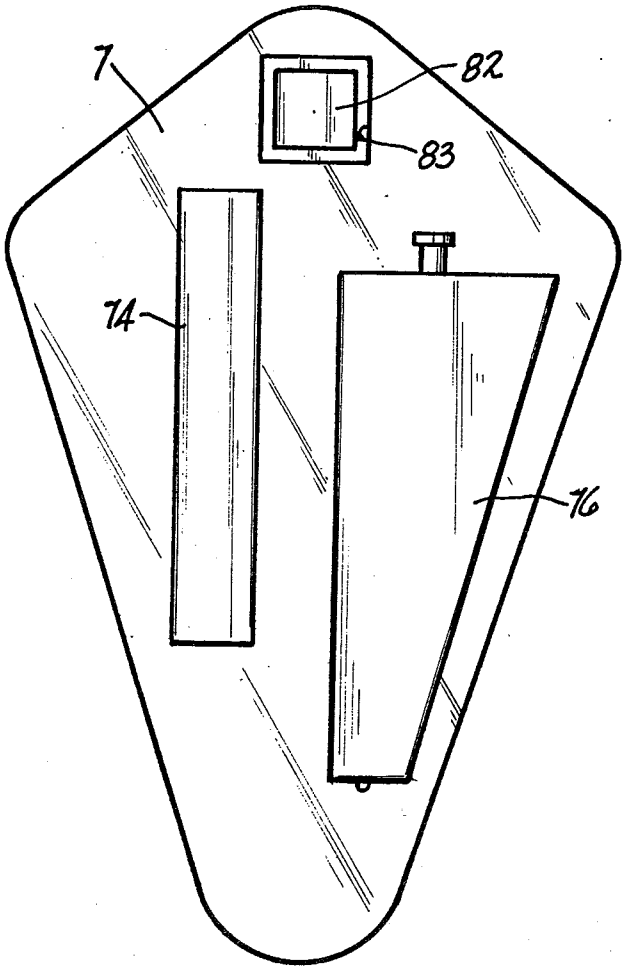
FIG. 4 is a schematic view of the mounting of parts on the right internal frame plate.

Referring now to FIG. 4, the carriage also includes an additional accumulator 74 mounted on the right side internal frame plate 7. An hydraulic fluid tank 76 is also mounted on the plate 7 as is a 12 volt jell-cell battery 82 which provides the power necessary to operate the various valves and radio receiver 80. The battery 82 is mounted in a foam-lined protective bay 83.

Figure 6:
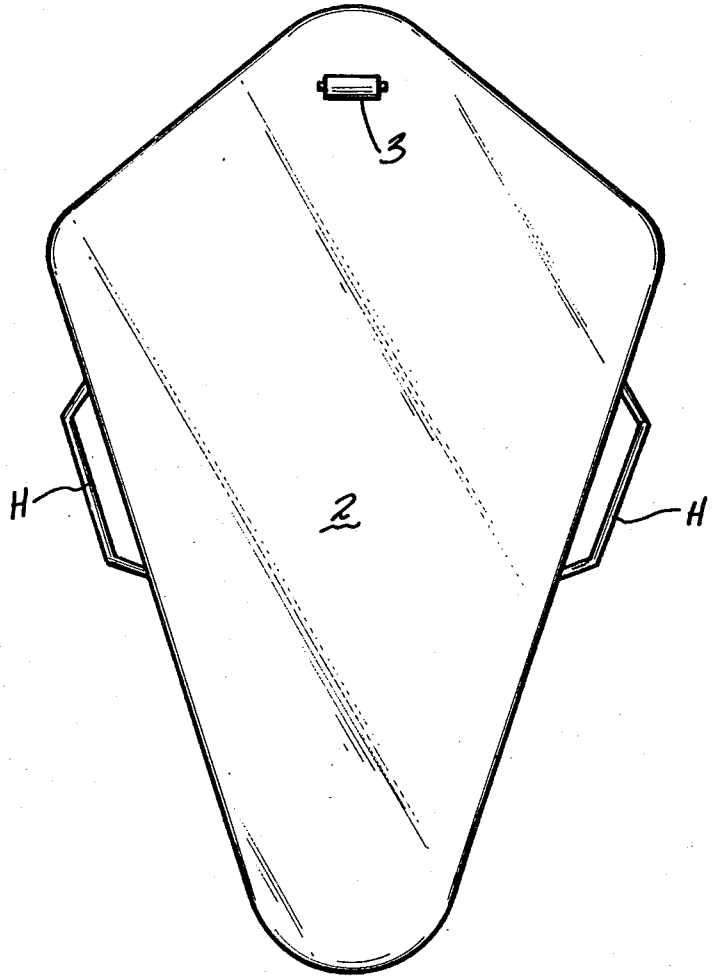
FIG. 6 is a schematic view of the left protective cover.
Figure 5:
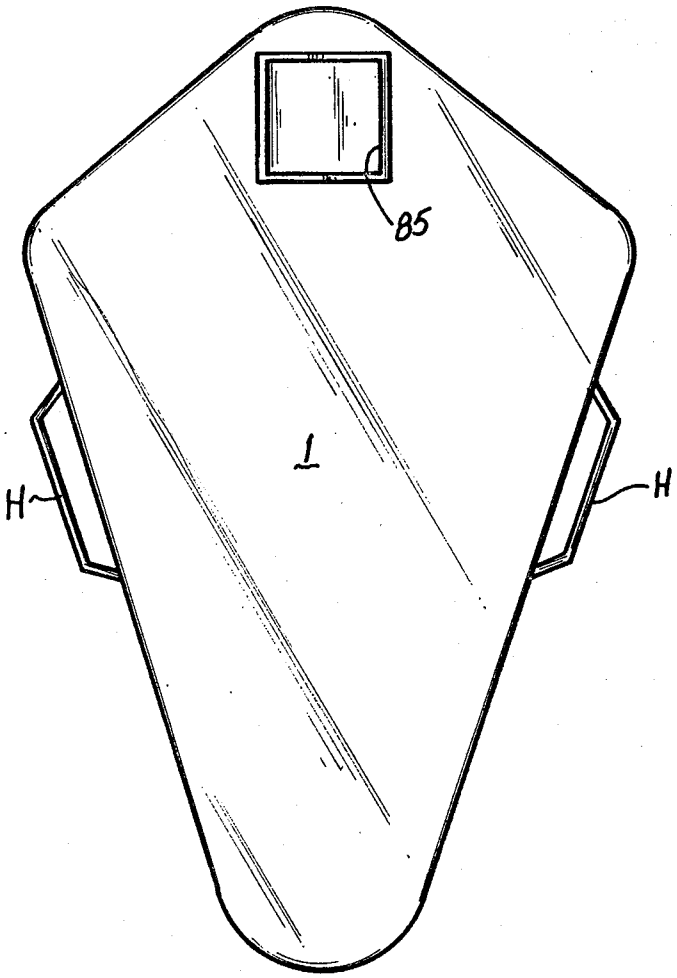
FIG. 5 is a schematic view of the right protective cover.

Referring to FIGS. 5 and 6 the right and left outer protective covers, 1 and 2 respectively, for the carriage are shown. The covers 1 and 2 are preferably formed from ¼ in. steel plate and both include manually graspable handles H formed on the sides thereof. The cover 1 includes an access port 85 for gaining access to the battery 82, and the cover 2 includes a cover switch 3 operable to turn the radio receiver 80 on or off.

Figure 7:
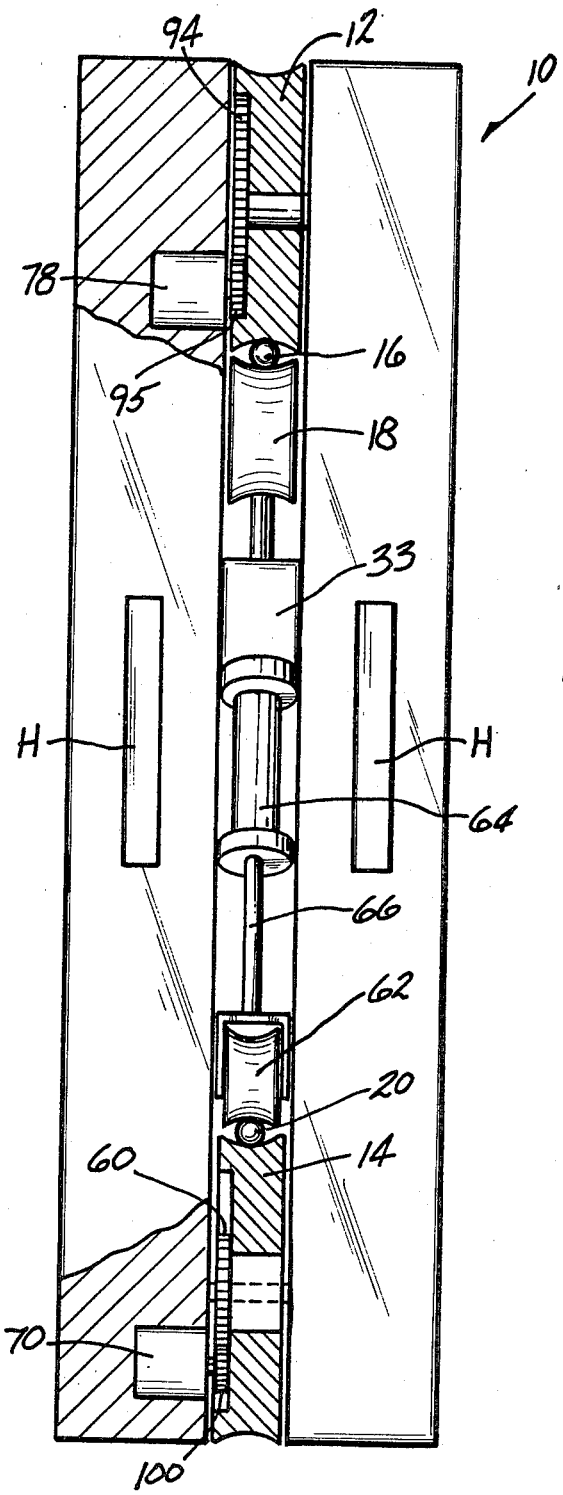
FIG. 7 is a schematic end view of the carriage from the anchor side thereof with parts thereof being shown in section for greater clarity.

FIG. 7 illustrates the hydraulic motor 70 cooperatively engaged with skidding line sheave 14 by means of the gears 60 and 100. The motor 70 thus causes the skidding line sheave 14 to make one revolution for each 3.09 cubic inches of hydraulic fluid passing through hydraulic motor 70. This ratio can, of course, be varied according to the size of the motor actually used. The fluid to operate hydraulic motor 70 and line lock assembly 32 is stored in accumulators 72, 73 and 74, which have a total capacity of 3¼ gallons. The hydraulic fluid after passing through hydraulic motor 70 and filter 52 is stored in the four gallon tank 76. In FIG. 7, the slave cylinder ram 66 is shown extended from the slave cylinder 64 so as to force the slave cylinder wheel 62 into contact with the skidding line 20 and thereby force the skidding line 20 into contact with the skidding line sheave 14.

FIG. 7 also shows pump 78 cooperatively engaged with skyline sheave 12; specifically, pinion gear teeth 94 on skyline sheave 12 cooperate with gear teeth on the driving member 95 of pump 78. As the carriage 10 is moved toward the cable logging machine on the skyline 16 during a log skidding operation, as described in detail below, each rotation of skyline sheave 12 will cause five rotations of the driving member 95 of pump 78. Each rotation of the driving member of pump 78 in turn will recirculate 0.92 cubic inches of hydraulic fluid from tank 76 to accumulators 72, 73 and 74. This ratio can also be varied by varying the size of the pump used. In FIG. 7, the brake cylinder 33 is shown fragmented so that a clearer view of the slave cylinder 64 will be had.

Figure 8:
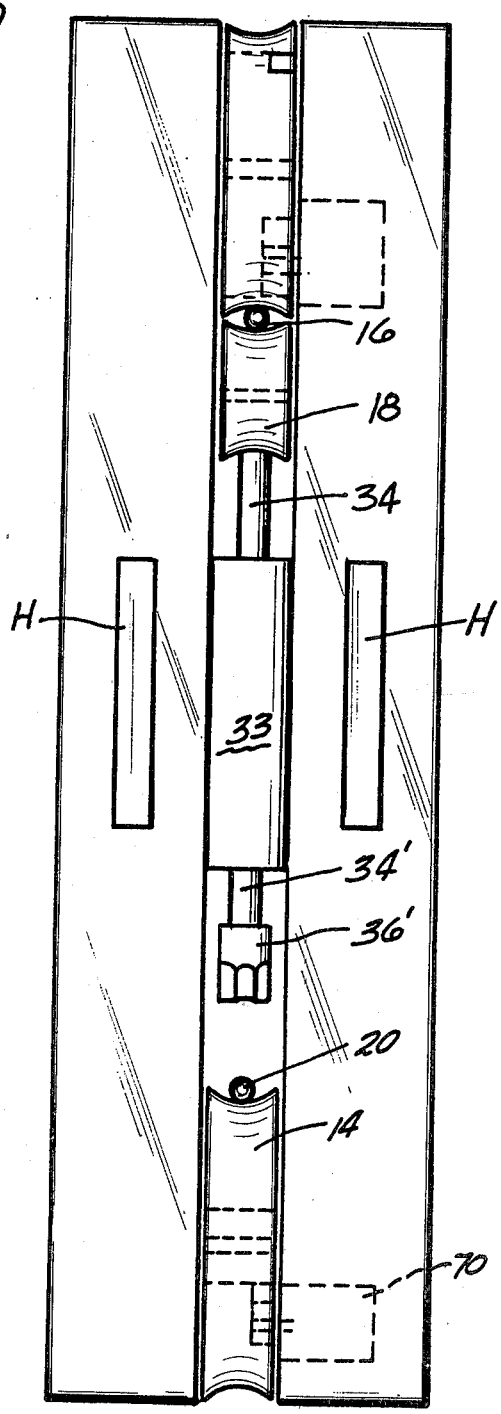
FIG. 8 is a schematic end view of the carriage from the cable logging machine side thereof.

Referring to FIG. 8, the carriage is shown in the skyline sheave-locking position wherein the ram 34 of the brake cylinder 33 is extended so that the upper brake shoe 36 locks the skyline 16 against the brake pad 38 (see FIG. 2). In this mode, the lower ram 34' of the brake cylinder 33 is retracted so that the lower brake shoe 36' is offset from the skidding line 20 and skidding line sheave 14. Thus, the motor 70 will be free to rotate the skidding line sheave 14 to pay out the skidding line 20 toward the ground to be attached to a log.

As previously noted, the subject apparatus includes within the carriage 10 a radio receiver 80 that cooperates with a standard transmitter (not shown) and with the hydraulic system described below to initiate the flow of hydraulic fluid from accumulators 72, 73 and 74 to hydraulic motor 70, slave cylinder 64 and brake cylinder 33.

Figure 9:
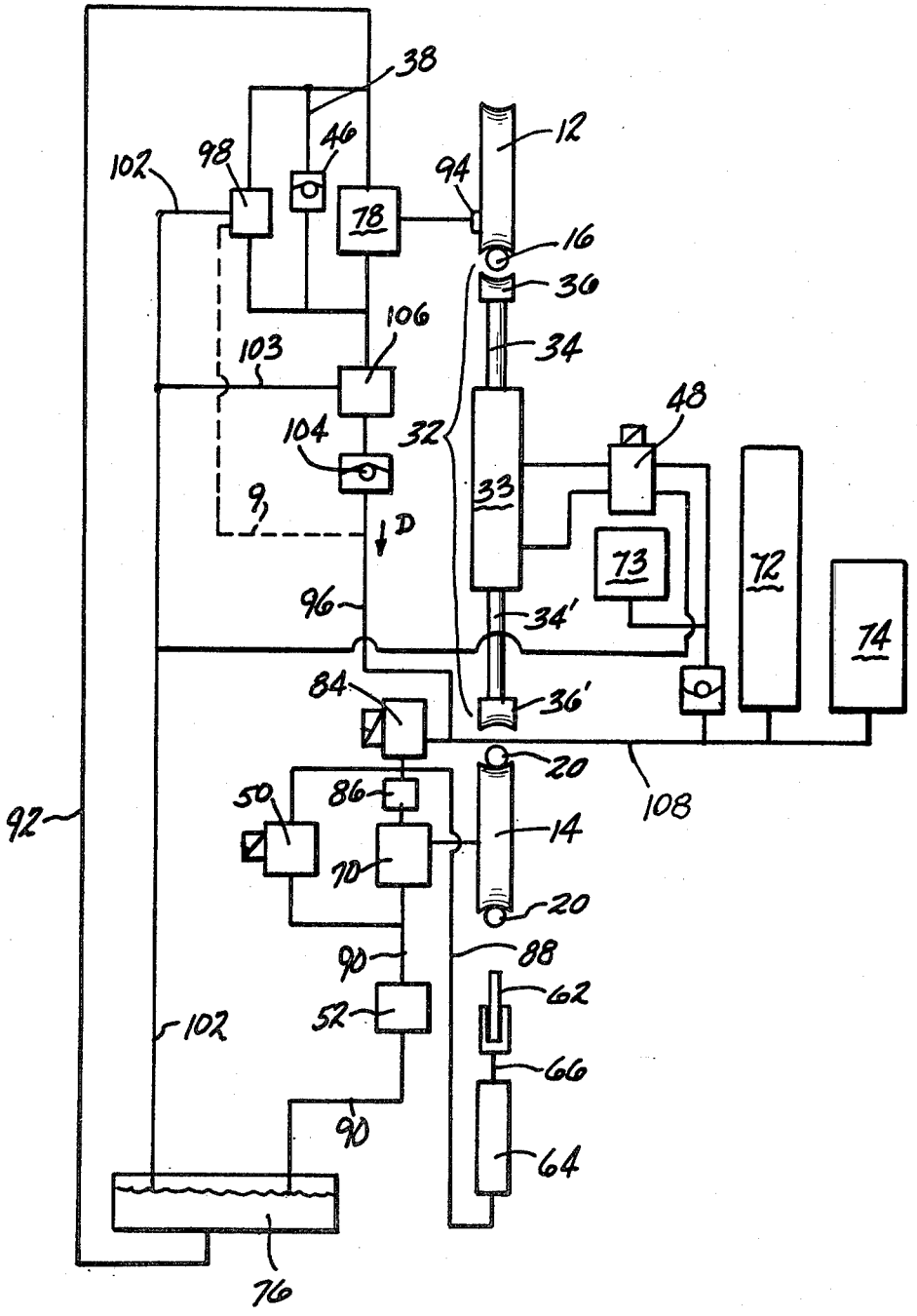
FIG. 9 is a schematic representation of the hydraulic and electronic system of the slack pulling and line lock apparatus of the invention.

FIG. 9 schematically illustrates the hydraulic/electronic system of the subject apparatus. Accumulators 72 and 74 retain the hydraulic fluid prior to a slack pulling operation by the apparatus. Each accumulator 72 and 74 can accommodate one and two gallons of hydraulic fluid respectively or 693 cubic inches, under pressures up to 2500 psi. Motor feed line 8 is preferably a three-eighth inch hydraulic tube extending from accumulators 72 and 74 to hydraulic motor 70. A radio controlled electrical valve 84 is located on motor feed line 8 intermediate hydraulic motor 70 and accumulators 72 and 74. Radio receiver 80 is a commercially available item used in many paging operations and is powered by the twelve volt gel cell battery. Radio receiver 80 cooperates with radio controlled valve 84 such that upon receipt of a signal from a transmitter (not shown), the radio controlled valve 84 can be opened to control the flow of hydraulic fluid from accumulators 72 and 74 to hydraulic motor 70. The transmitter used in conjunction with radio receiver 80 may be a commercially available MX Motorola Walkie-Talkie that is used in many field operations, and that includes a separate button for transmitting signals to a paging receiver such as receiver 80.

The flow control valve 86 is located intermediate radio controlled valve 84 and hydraulic motor 70 to allow control of slack pulling rate by controlling flow of hydraulic fluid to hydraulic motor 70. Slave cylinder line 88 extends to slave cylinder 64 from a point on motor feed line 8 intermediate radio controlled valve 84 and flow controlled valve 86. When hydraulic fluid flows through motor feed line 8 toward hydraulic motor 70, hydraulic pressure is applied to slave cylinder 64 to force slave cylinder ram 66 and slave cylinder wheel 62 toward skidding line sheave 14. The movement of slave cylinder wheel 62 toward skidding line sheave 14 forces skidding line 20 into contact with both skidding line sheave 14 and slave cylinder wheel 62. Hydraulic motor 70 causes skidding line sheave 14 to make 3.28 revolutions for every 3.09 cubic inches of hydraulic fluid passing through hydraulic motor 70. The rotation of skidding line sheave 14, while in contact with skidding line 20, advances skidding line 20 through carriage 10. Slave cylinder wheel 62 freely rotates on slave cylinder ram 66 thereby facilitating the movement of skidding line 20 through carriage 10.

A discharge line 90 extends from hydraulic motor 70 to filter 52 then to tank 76. Thus, hydraulic fluid passing through hydraulic motor 70 is carried by discharge line 90 to tank 76. To ensure that the chokesetter can pull the skidding line through carriage 10 without activating the slack puller function, it is necessary that motor 70 be able to turn freely. Radio controlled valve 50 works in concert with radio controlled valve 84, such that valve 50 is open when valve 84 is closed and the reverse. When valve 50 is open, skidding line sheave 14 turns freely. As mentioned above, tank 76 has a capacity of four gallons, which is greater than the combined capacity of accumulators 72, 73 and 74.

A recirculation line 92 extends from tank 76 to recharge pump 78 that includes driving gear 94, which cooperates with gear teeth (not shown) on skyline sheave 12, as previously noted. After drag line 20 and attached logs (not shown) have been pulled into the carriage to a sufficient extent by the cable logging machine, the choke-setter activates the appropriate signal button on his walkie-talkie radio, which activates valve 48, which causes lock assembly 32 to release the skyline 16 and secures skidding line 20 such that the logs are snubbed with their attached ends above the ground surface. Subsequent in-hauling of drag line 20 will also pull carriage 10 toward the cable logging machine in the direction shown by arrow C, in FIG. 2. The weight of the log 15 and of the carriage 10 will cause skyline sheave 12 to rest on and roll along skyline 16 as carriage 10 and the log advance simultaneously toward the cable logging machine. Guide wheels 18 ensure that sufficient frictional contact is made between skyline sheave 12 and skyline 16 to prevent slippage.

Returning to FIGS. 2 and 3, the rolling rotational movement of skyline sheave 12 along skyline 16 as the carriage 10 is advanced toward the cable logging machine causes the gear teeth 94 on skyline sheave 12 to interact with gear 95 and thereby to drive recharge pump 78. The gear teeth 94 on skyline sheave 12 and on gear 95 are arranged such that one rotation of skyline sheave 12 results in five complete rotations of gear 95. In turn, each rotation of gear 95 resulting from the advance of carriage 10 toward the skidding machine causes 0.92 cubic inches of hydraulic fluid to be pumped from tank 76 through recirculation line 92. This hydraulic fluid is then advanced through recharge line 96 to accumulators 72, 73 and 74 (see FIG. 9).

Returning to FIG. 9, sequence valve 98 is connected to each side of recharge pump 78, such that during the time that accumulators 72, 73 and 74 are being recharged, the hydraulic fluid passes from recirculation line 92 through pump 78 and into recharge line 96. Pressure line 9 extends from sequence valve 98 to accumulators 72, 73 and 74 to measure the hydraulic pressure in accumulators 72, 73 and 74. Specifically, as accumulators 72, 73 and 74 are recharged, the hydraulic pressure therein increases. When accumulators 72, 73 and 74 are recharged to their maximum total capacity of $3\frac{1}{4}$ gallons, the hydraulic pressure therein will be approximately 2,000 pounds per square inch. Sequence valve 98 is set to divert the flow of hydraulic fluid from accumulators 72, 73 and 74 to diversion line 102 once the hydraulic pressure therein equals 2,000 pounds per square inch. When this pressure is achieved, recharge pump 78 will continue to operate, however, the hydraulic fluid will be diverted back to reservoir 76 through diversion line 102.

As also illustrated in FIG. 9, check valve 104 is located on recharge line 96 intermediate recharge pump 78 and accumulators 72, 73 and 74. The check valve 104 is operative to insure that the hydraulic fluid flows through recharge line 96 only in the direction shown by the arrow D in FIG. 9. Thus, after the recharging operation has ceased, and particularly when a slack feeding operation is in progress, the hydraulic fluid is not able to travel through recharge line 96 toward recharge pump 78.

The accumulator 73 is a 1 quart capacity vessel which is located behind the check valve 105 communicating with line 108. This accumulator 73 is a back-up fail-safe accumulator which will serve to operate the line lock assembly 32 should the pressure in accumulators 72 and 74 drop to zero, or if there is a broken line resulting in a drop in pressure in the system.

Relief valve 106 is connected to recharge line 96 intermediate recharge pump 78 and check valve 104. The relief valve 106 is essentially a fail-safe device that can direct fluid to tank 76 via line 103 if check valve 104 closes while recharge pump 78 is still operating, or if pressure in the system exceeds 2500 psi.

Referring to all of the FIGURES, at the beginning of a skidding operation, carriage 10 would be located in close proximity to cable logging machine 11. Skyline 16 and skidding line 20 both extend through carriage 10; the brake is locked on skidding line sheave 14. Cable logging machine 11 unwinds skyline 16 and the workers then attach the free end of skyline 16 to anchor 13. Skidding machine 11 then pulls skyline 16 taut and releases the braked skidding line winch 5. The force of gravity acting upon carriage 10 will cause the skyline sheave 12 to roll downwardly along skyline 16 thereby moving carriage 10 toward anchor point 13. The interaction of line lock assembly 32 on the carriage 10 with skidding line 20 will cause skidding line 20 to move with carriage 10 downhill toward anchor point 13. As carriage 10 approaches the logs 15 to be skidded, the radio controlled line lock assembly 32 is switched from the skidding line sheave 14 to skyline sheave 12, thereby stopping the downward movement of carriage 10 and simultaneously disengaging skidding line 20 from carriage 10.

Next, workers would attach the free end of skidding line 20 to the log 15 to be skidded. However, as explained above, the log 15 to be skidded frequently will be several feet away from carriage 10. Therefore, log skidding machine 11 will unwind skidding line 20, and a worker will pull the free end of the skidding line through carriage 10 toward the log 15 to be skidded. To facilitate this slack pulling, the worker transmits the appropriate electrical signal from his radio tranmitter. The message transmitted thereby will be received by radio receiver 80 within carriage 10 which, in turn, will open radio controlled valve 84 and will close valve 50, as shown in FIG. 9. Hydraulic fluid will then pass through motor feed line 108 and to slave cylinder line 88. As a result, slave cylinder 64 will push slave cylinder ram 66 and slave cylinder wheel 62 into contact with skidding line 20, thereby forcing skidding line 20 into contact with skidding line sheave 14. Simultaneously, hydraulic fluid will pass from accumulators 72 and 74 through hydraulic drive line 108 to operate the hydraulic motor 70. Skidding line sheave 14 will be turned by hydraulic motor 70 advancing the skidding line 20 through carriage 10. As cable logging machine 11 produces slack in skidding line 20, skidding line sheave 14 will advance that slack skidding line 20 through carriage 10. As a result, the distance over which slack has to be pulled will be greatly reduced, thereby significantly reducing the force that must be exerted by the worker in pulling the slack skidding line to log 15.

After the free end of skidding line 20 is firmly attached to log 15, cable logging machine 11 commences its in-haul of skidding line 20. The initial phase of this in-haul will advance log 15 toward carriage 10. As log 15 approaches carriage 10, the worker will switch the electronic hydraulic valve 48 so that the brake switches from skyline sheave 12 to skidding line sheave 14. Subsequent in-haul of skidding line 20 will move both log 15 and carriage 10 toward cable logging machine 11. Movement of carriage 10 toward log skidding machine 11 will cause skyline sheave 12 to roll along skyline 16. This rotational movement of skyline sheave 12 will drive recharge pump 78 in the manner described above thereby recharging accumulators 72, 73 and 74. In many operations, accumulators 72, 73 and 74 will be completely recharged before carriage 10 reaches log skidding machine 11. As explained above, and as shown schematically in FIG. 9, upon complete recharge (2000 psi) of accumulators 72, 73 and 74, sequence valve 98 will redirect all pumped hydraulic fluid back to tank 76.

After removal of log 15 from the free end of skidding line 20, cable logging machine 11 unwinds skidding line 20 so that the force of gravity on carriage 10 urges carriage 10 to roll down skyline 16 in the manner described above. As shown in FIG. 9, check valve 46 in recirculation line 38 allows pump 78 to circulate hydraulic fluid in a circular route which enables skyline sheave 12 to turn freely on skyline 16. Accumulators 72, 73 and 74 normally would be completely recharged prior to the descent of carriage 10. As a result, workers immediately could proceed to move the free end of skidding line 20 to the next log(s) to be skidded.

In summary, a new and improved log skidding carriage is provided with a slack feeding apparatus that greatly facilitates the movement of the skidding line from the carriage to the log to be skidded and a carriage lock device. The slack feeding apparatus and the carriage lock device are operated hydraulically. The carriage includes at least one accumulator that stores hydraulic fluid prior to the slack feeding operation and to operate the slack feeding assembly. A radio controlled valve allows the hydraulic fluid to force the skidding line into contact with the skidding line sheave and to operate a hydraulic motor that rotates the skidding line sheave thereby feeding slack through the carriage. Hydraulic fluid that passes through the hydraulic motor is stored in a tank. The tank is connected to a pump which in turn is connected to a sheave in the carriage. The cooperation between the sheave and the pump enables the accumulators to be recharged as the log is being skidded to the cable logging machine. A sequence valve, a relief valve and check valves are provided in the log skidding carriage to insure the proper operation of the apparatus.

The carriage also includes at least one accumulator that stores hydraulic fluid prior to operating the line lock assembly. A separate radio controlled valve allows the hydraulic fluid to alternately force brake shoes into contact with the skyline and its sheave or into contact with the skidding line and its sheave by means of a double-acting brake cylinder and brake cylinder rams. When the skyline is locked, the carriage is held immobile and the skidding line can be freely fed through the carriage for the purpose of attaching logs. When the logs are pulled back to the carriage, the brake shoes are released from the skyline and secure the skidding line. The carriage is then able to freely travel on the skyline, and the carriage and attached logs can be pulled to the cable logging machine.

While the preferred embodiment of the subject invention has been described and illustrated, it is obvious that various changes and modifications can be made therein without departing from the spirit of the present invention. Accordingly, it is emphasized that the present invention should be limited only by the scope of the appended claims.

What is claimed is:

1. A cable logging carriage comprising:
(a) a frame;
(b) a skyline sheave mounted on said frame for engagement with a skyline whereby said carriage can traverse the skyline;
(c) a brake pad disposed adjacent to said skyline sheave;
(d) a skidding line sheave mounted on said frame and spaced apart from said skyline sheave, said skidding line sheave being operable to engage a skidding line which is adapted to be attached to cut logs;
(e) a single hydraulic cylinder mounted on said frame and interposed between said skyline and skidding sheaves;
(f) a first ram member movably mounted on said cylinder and extending from one end thereof toward said skyline sheave, said first ram member being movable between an extended position and a retracted position;
(g) a first brake shoe mounted on a distal end of said first ram member and operable with said brake pad to grip the skyline when said first ram member is in said extended position to lock said carriage in a fixed position on the skyline;
(h) a second ram member movably mounted on said cylinder and extending from the other end thereof toward said skidding line sheave, said second ram member being movable between an extended position and a retracted position.
(i) a second brake shoe mounted on a distal end of said second ram member and operable to grip the skidding line against said skidding line sheave when said second ram member is in said extended position to lock the skidding line to said carriage; and
(j) means for selectively supplying hydraulic fluid to said hydraulic cylinder to selectively move said first ram member to its extended position while concurrently moving said second ram member to its retracted position and visa versa.

2. The cable logging carriage of claim 1 further comprising a radio signal receiver mounted on said frame and operable to energize said means for selectively supplying hydraulic fluid to said hydraulic cylinder.

* * * * *